United States Patent [19]

Schumacher, Jr. et al.

[11] 4,444,281

[45] Apr. 24, 1984

[54] COMBINATION DRAG AND ROLLER CUTTER DRILL BIT

[75] Inventors: Percy W. Schumacher, Jr., Houston; Kenneth W. Jones, Kingwood; Henry W. Murdoch; Paul E. Pastusek, both of Houston, all of Tex.

[73] Assignee: Reed Rock Bit Company, Houston, Tex.

[21] Appl. No.: 480,560

[22] Filed: Mar. 30, 1983

[51] Int. Cl.[3] ..... E21B 10/14

[52] U.S. Cl. ..... 175/336; 175/329

[58] Field of Search ..... 175/336, 330, 329, 393, 175/410, 339, 374, 376, 378

[56] References Cited

U.S. PATENT DOCUMENTS

| | | | |
|---|---|---|---|
| 4,006,788 | 2/1977 | Garner | 175/330 |
| 4,285,409 | 8/1981 | Allen | 175/336 |
| 4,343,371 | 8/1982 | Baker | 175/329 |
| 4,359,112 | 11/1982 | Garner et al. | 175/336 X |

*Primary Examiner*—James A. Leppink
*Assistant Examiner*—Thuy M. Bui
*Attorney, Agent, or Firm*—Carl Rowold

[57] ABSTRACT

A rotary drill bit comprising a bit body having at least one depending leg at its lower end and at least one roller cutter rotatably mounted on the leg. The roller cutter comprises a frustoconical roller cutter body and a plurality of cutting elements projecting from the cutter body to tips adapted to bear on the bottom of the well bore, with the tips defining, upon rotation of the bit, a first cutting surface of the bit extending over substantially the entire area of the bottom of the well bore. At least one drag cutter extends down from the bit body and comprises a support and a plurality of drag cutting elements on the support, each having a lower cutting edge. The cutting edges of these elements are so arranged relative to the tips of the hard metal cutting elements as to define, upon rotation of the bit, a second cutting surface of generally the same configuration as the first but spaced above it, whereby upon drilling a relatively brittle formation only the hard metal cutting elements bear on the formation for cutting the formation by fracturing it thereby protecting the drag cutting elements, and upon drilling a relatively plastically deformable material which the hard metal cutting elements penetrate to a relatively deep depth without causing substantial fracturing of the formation, the drag cutting elements also engage the formation for improved drill bit cutting action and increased rates of drilling penetration.

6 Claims, 4 Drawing Figures

COMBINATION DRAG AND ROLLER CUTTER DRILL BIT

BACKGROUND OF THE INVENTION

This invention relates to rotary drill bits for drilling well bores in the earth, and more particularly to rotary drill bits having both conical roller cutters and drag cutters.

This invention involves an improvement over combination rotary drill bits of the type, such as shown, for example, in U.S. Pat. Nos. 4,006,788 and 4,285,409, comprising a plurality of rotatably mounted roller cutters each having a generally conical roller cutter body and a plurality of cutting elements on the body, and a plurality of drag cutting elements mounted on supports extending down between the roller cutters. The cutting elements on the roller cutters "drill" the formation by crushing or fracturing it. In contrast, the drag cutting elements "drill" by shearing the formation, which offers faster rates of penetration than drilling by crushing for certain types of formation. Combination drill bits attempt to advantageously utilize the differences in cutting action of these two types of cutting elements by positioning the cutting elements on the bit in predetermined relation with respect to each other such that each type of cutting element performs the cutting function for which it is best suited. For example, in U.S. Pat. Nos. 4,006,788 and 4,285,409, the drag cutting elements are so positioned relative to the cutting elements on the roller cutters that the cutting edges of the drag elements are at or slightly below the bottom of the paths followed by the tips of the cutting elements on the roller cutters. This arrangement of cutting elements enables both types of cutting elements to be supported in drilling engagement with well bore bottom. In addition, because the drag elements are of a diamond material which is subject to rapid deterioration upon excessive heat build-up, this arrangement also serves to extend the useful life of the drag elements by limiting their penetration into the formation, the amount of formation they remove, and thus the amount of heat generated at their cutting edges.

However, these conventional combination drill bits have not proven to be entirely satisfactory in that their drag cutting elements still experience excessive heat build-up and thus have shortened useful lives, particularly when the bit is used to drill certain types of formations. This heat build-up is believed to be due to the fact that the drag cutting elements are in substantially continuous cutting engagement with the formation. Thus heat is continuously generated at the cutting edges of the drag elements. and, at the same time, the cutting edges of the elements at no time are exposed to the drilling fluid so as to be washed and cooled by the relatively cool drilling fluid as it flows over the well bore bottom. The problem of overheating due to continuous cutting engagement is particularly critical in drilling relatively plastically deformable formations which the drag cutting elements penetrate relatively deeply. Many commonly encountered formations, such as salts, shales, limestones, sandstones, and chalks, become plastically deformable under so-called differential pressure conditions, when the hydrostatic pressure of the column of drilling fluid bearing on the well bore bottom exceeds the pore pressure of the formation surrounding the bore, as often occurs in deep hole drilling.

SUMMARY OF THE INVENTION

Among the several objects of this invention may be noted the provision of an improved combination drag and roller cutter drill bit; the provision of such a drill bit which has a longer useful life than conventional combination drill bits, particularly in drilling relatively plastically deformable formations; the provision of such a drill bit which has drag elements which are not subjected to excessive heat build-up, even when the bit is used to drill plastically deformable formations; the provision of such a drill bit in which its drag elements engage the well bore bottom only on a non-continuous (i.e., interrupted) basis, provision of such a drill bit which provides periods of time during which the cutting edges of the drag elements are exposed to the drilling fluid which cools and cleans the cutting edges of the drag elements; the provision of such a drill bit which holds its drag elements out of cutting engagement with the well bore bottom when the drill bit is used to drill relatively brittle formations; and the provision of such a drill bit which utilizes the different cutting actions of the roller cutter cutting elements and the drag cutting elements to provide higher overall rates of drilling penetration for the bit than is possible with conventional combination bits, particularly when drilling relatively plastically deformable formations.

In general, the drill bit of this invention comprises a bit body having a threaded pin at its upper end adapted to be detachably secured to drill pipe or the like for rotating the bit, and at least one depending leg at its lower end having a generally cylindrical bearing journal. At least one roller cutter is rotatably mounted on the bearing journal. The roller cutter comprises a generally frustoconical roller cutter body and a plurality of hard metal cutting elements thereon. The cutting elements project outwardly beyond the roller cutter body to tips adapted to bear on the formation at the bottom of the well bore for drilling the formation by crushing it, with the tips of the cutting elements, upon rotation of the bit, defining a first cutting surface of the bit extending over substantially the entire area of the bottom of the well bore. At least one drag cutting means is provided on the bit comprising a support on the bit body and a plurality of drag cutting elements on the support each having a lower cutting edge. The cutting edges of the drag cutting elements are so arranged relative to the tips of the hard metal cutting elements as to define, upon rotation of the bit, a second cutting surface of generally the same configuration as the first cutting surface but spaced above it a distance less than the protrusion length of the hard metal cutting elements, whereby upon drilling a relatively brittle formation, which the hard metal cutting elements penetrate only slightly, only the hard metal cutting elements bear on the formation for cutting the formation by fracturing the formation between adjacent hard metal cutting elements, thereby protecting the drag cutting elements, and upon drilling a relatively plastically deformable material, which the hard metal cutting elements penetrate to a relatively deep depth without causing substantial fracturing of the formation between adjacent hard metal cutting elements, both the hard metal and the drag cutting elements engage the formation for improved drill bit cutting action and increased rates of drilling penetration.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
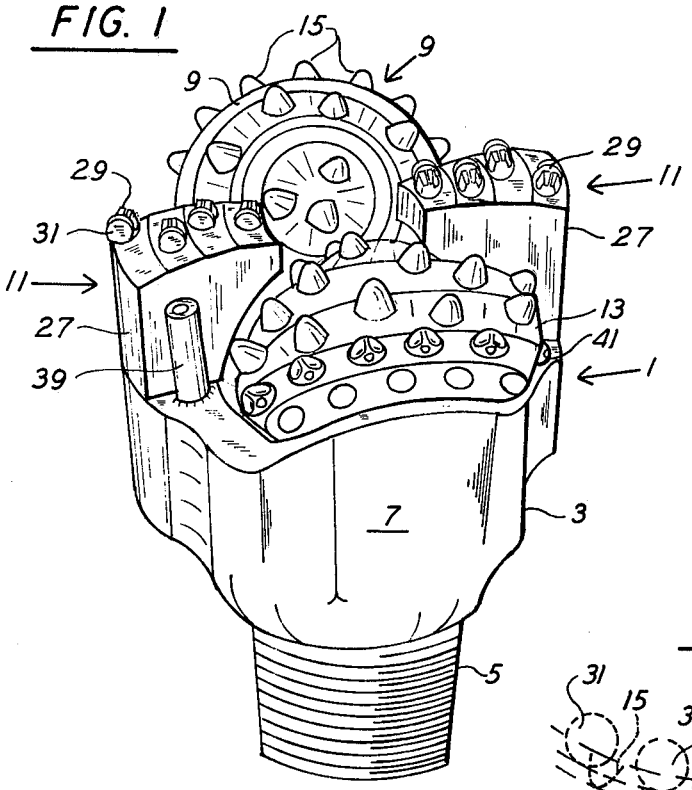
FIG. 1 is a perspective of a drill bit of this invention comprising a pair of roller cutters having hard metal cutting elements and a pair of drag cutting means having drag cutting elements, the bit being shown in inverted position.

Referring to FIG. 1, there is generally indicated at 1, a combination drag and roller cutter drill bit of this invention used to drill a bore, such as an oil well bore, in the earth. The bit comprises a bit body 3 having a threaded pin 5 at its upper end, with its bit in upright position as used in drilling a bore, (its lower end with the bit in inverted position as shown in FIG. 1). The pin is used to detachably secure the bit to drill pipe, drill string, or a so-called "sub" for rotating the bit. The bit body further has a plurality of legs 7 (i.e., two such legs 7, with one leg 7 being shown in FIG. 1) at its end opposite the pin (i.e., its lower end with the bit in use). The legs 7 are spaced apart from each other, with each leg having a generally cylindrical bearing journal (not shown) at its lower end. The bit body further has passaging therein (not shown) and nozzles (also not shown) mounted thereon for flow of drilling fluid under pressure from the passage in the drill pipe, through the bit body, and then against the bottom of the well bore. The drilling fluid cools the bit, enhances its cutting action, and carries away drilling debris. The drill bit further comprises a plurality of roller cutters 9 (two roller cutters 9 being illustrated in FIG. 1) rotatably mounted on the bearing journals on the legs, and at least one drag cutting means 11 (two cutting means 11 being illustrated in FIG. 1) extending between a set of adjacent roller cutters.

Figure 3:
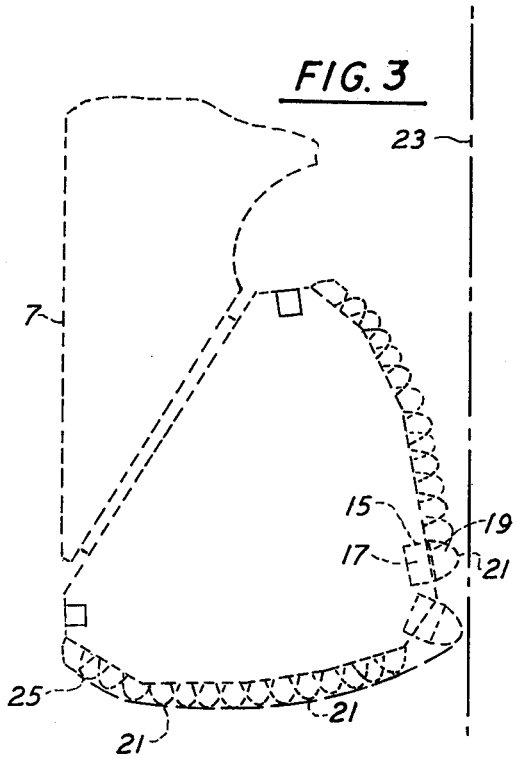
FIG. 3 is a schematic view of one roller cutter of the bit showing the radial bottom hole coverage of the hard metal cutting elements.

Each roller cutter 9 comprises a generally frustoconical roller cutter body 13 having a recess (not shown) therein receiving the respective bearing journal, and a plurality of cutting elements 15 arranged in annular rows thereon. These cutting elements or so-called inserts comprise elongate members of a suitable hard metal, such as a tungsten carbide material, and have a generally cylindrical base portion 17 secured in bores formed in the conical outer surface of the roller cutter body. Each insert also has a projecting portion 19 extending outwardly beyond the outer surface of the roller cutter body. This projecting portion, which is shown in the FIGS. as being of conical shape, but may also be of other shapes such as spherical, ogive, or chisel, tapers outwardly to a tip or point 21. During drilling with the bit, the tips 21 of the inserts bear on the formation at the bottom of the well bore for drilling the formation by crushing it. As illustrated in FIG. 3, the rows of inserts 15 on the two roller cutters are so arranged relative to each other and the centerline 23 of the bit that on rotation of the drill bit the groove cut in the formation by each row of inserts overlaps the groove cut by at least one row of inserts on the other roller cutter. The inserts together thus define a first cutting surface (designated by line 25 in FIGS. 3 and 4) of the bit extending over substantially the entire area of the bottom of the well bore. As viewed in section on a vertical radial bit plane emanating from the centerline of the bit as shown in FIG. 3, this first cutting surface 25 is of upwardly opening concave shape.

Figure 4:
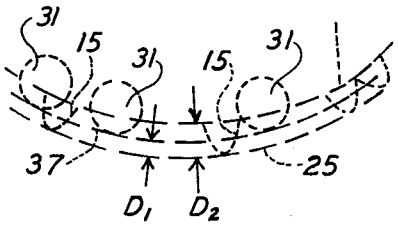
FIG. 4 is a schematic view showing the position of the cutting surface defined by the drag cutting elements relative to that defined by the hard metal cutting elements.
Figure 2:
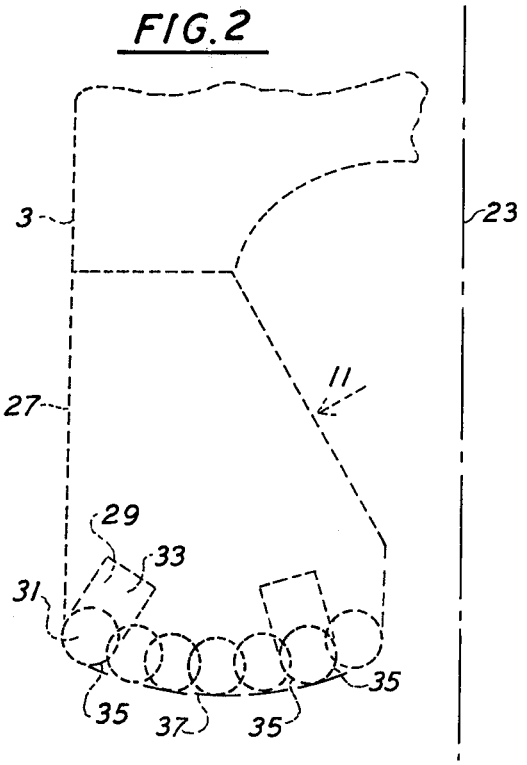
FIG. 2 is a schematic view of one drag cutting means, when the bit is in upright position, showing the radial bottom hole coverage of the drag cutting elements upon rotation of the bit.

Each drag cutting means 11 comprises a support 27 of generally L-shape in longitudinal section. The end of one leg of the support 27 is secured as by welding to the bit body 3 and the outer face of the other leg extends radially inwardly of the bit 1 at the bottom thereof. The drag cutting means 11 further comprises a plurality of drag cutting elements 29 (seven such elements as illustrated) on the outer face of the legs of the supports 27. The drag cutting elements which may be of the type commercially available under the tradename Stratapax from the Specialty Material Department of General Electric Company of Worthington, Ohio, comprise a disc-shaped layer 31 of polycrystalline diamond material bonded on a stud 33 of tungsten carbide material at an end thereof. The studs 33 are secured in bores formed in the supports. A portion of each stud and the disc 31 of diamond material bonded thereto project downward beyond the support 27 so that the disc presents a cutting edge 35. The cutting edges 35 of the drag cutting elements are so arranged relative to each other as to define a second cutting plane (designated by the line 37 in FIGS. 2 and 4) covering an annular area at the well bore bottom which is a substantial portion of the area of the bottom. In addition, the drag cutting elements are so positioned relative to the inserts 15 that the second cutting plane 37, as shown in FIG. 4, is of generally the same configuration as the first cutting surface 25 but spaced above it a distance, designated D1 in FIG. 4, less than the protrusion length, designated D2 in FIG. 4, of the inserts. Preferably the distance D1 between the first and second cutting planes is approximately one-half the protrusion length D2 of the projecting portion of the inserts. However, it is contemplated the ratio between D1 and D2 may be somewhat more or less than one-half.

In the use of the drill bit 1 to drill a bore in relatively brittle formations, which the inserts 15 penetrate only slightly under the weights normally applied to the bit, only the inserts 15 engage the formation, with the inserts drilling the formation by cracking or fracturing it. In contrast, the drag cutting elements 29 are supported above the bottom of the well bore, thus being held out of engagement with the formation and protected. In the use of the drill bit 1 to drill relatively plastically deformable formations which the inserts 15 penetrate to a relatively deep depth, perhaps as much as the full protrusion length D2 of the inserts, both the inserts and the drag cutting elements engage the formation. Because of the plastic nature of the formation, the inserts crack or fracture the formation only to a limited extent and tend to form a plurality of indentations or recesses in the well bore bottom. The cutting edges 35 of the drag cutting elements 29 engage the ridges between these indentations in the well bore bottom and shear the peaks of this ridges to expose fresh formation. This combined cutting action of the inserts 15 and drag cutting elements 29 provides improved overall drill bit cutting action and increased rates of drilling penetration.

It will be observed from the foregoing that when the bit of this invention is used to drill relatively brittle formations, which the inserts are able to drill effectively, only the inserts engage the formation and the drag cutting elements are held out of engagement thereby prolonging the useful life of the drag cutting elements. However, when the bit is used to drill relatively plastically deformable formations which the inserts do not effectively drill, the drag cutting elements engage the formation but only on a non-continuous (i.e., interrupted) basis. This non-continuous engagement limits the generation of heat at the cutting edges 35 of the drag cutting elements 29, and enables the cutting edges to be exposed to the drilling fluid for short periods of time so as to be washed clean of formation cuttings and other drill debris and to be cooled by the drilling fluid as it flows past the bottom of the bit. The build-up of excessive heat and temperatures at the cutting edge of the drag cutting elements is thus prevented, and the useful life of the drag cutting elements is thus significantly increased.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed:

1. A rotary drill bit for drilling a well bore, the bit comprising:

a bit body having a threaded pin at its upper end adapted to be detachably secured to drill pipe or the like for rotating the bit, and at least one depending leg at its lower end having a generally cylindrical bearing journal;

at least one roller cutter rotatably mounted on the bearing journal, said roller cutter comprising a generally frustoconical roller cutter body and a plurality of hard metal cutting elements thereon, said cutting elements projecting outwardly beyond the roller cutter body to tips adapted to bear on the formation at the bottom of the well bore for drilling the formation by crushing it, the tips, upon rotation of the bit, defining a first cutting surface of the bit extending over substantially the entire area of the bottom of the well bore; and at least one drag cutting means comprising a support on the bit body and a plurality of drag cutting elements on the support each having a lower cutting edge, said cutting edges of the drag elements being so arranged relative to the tips of the hard metal cutting elements as to define, upon rotation of the bit, a second cutting surface of generally the same configuration as the first cutting surface but spaced above it a distance less than the protrusion length of the hard metal cutting elements, whereby upon drilling a relatively brittle formation, which the hard metal cutting elements penetrate only slightly, only the hard metal cutting elements bear on the formation for cutting the formation by fracturing the formation between adjacent hard metal cutting elements thereby protecting the drag cutting elements, and upon drilling a relatively plastically deformable material, which the hard metal cutting elements penetrate to a relatively deep depth without causing substantial fracturing of the formation between adjacent hard metal cutting elements, both the hard metal and the drag cutting elements engage the formation for improved drill bit cutting action and increased rates of drilling penetration.

2. A rotary drill bit as set forth in claim 1 wherein said drag cutting elements are mounted on the bit at predetermined spaced intervals from the vertical centerline of the bit such that the grooves cut in the bottom of the well bore by the drag cutting elements upon rotation of the drill bit overlap each other.

3. A rotary drill bit as set forth in claim 1 wherein the first cutting surface is of upwardly opening concave shape as viewed in section on a vertical radial plane through the bit emanating from the centerline of the bit.

4. A rotary drill bit as set forth in claim 1 wherein the second cutting surface is spaced above the first a distance corresponding to approximately one-half the protrusion length of the hard metal cutting elements.

5. A rotary drill bit as set forth in claim 1 wherein the second cutting surface defines an annular area which is a substantial portion of the area of the bottom of the well bore.

6. A rotary drill bit as set forth in claim 1 wherein each hard metal cutting elements comprises an elongate member of tungsten carbide mounted on the cutter body and each drag cutting element comprises a generally planar member of diamond on a stud depending from the respective support.

* * * * *